US006896061B2

(12) United States Patent
Hriscu et al.

(10) Patent No.: US 6,896,061 B2
(45) Date of Patent: May 24, 2005

(54) MULTIPLE ZONES FRAC TOOL

(75) Inventors: Iosif J. Hriscu, Duncan, OK (US); Don S. Folds, Duncan, OK (US); Gregory W. Vargus, Duncan, OK (US); Thomas W. Hawkins, Marlow, OK (US); John T. Brandell, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 94 days.

(21) Appl. No.: 10/116,572

(22) Filed: Apr. 2, 2002

(65) Prior Publication Data

US 2003/0183391 A1 Oct. 2, 2003

(51) Int. Cl.[7] ..... E21B 43/12; E21B 33/124

(52) U.S. Cl. ..... 166/313; 166/119; 166/120; 166/387; 166/191

(58) Field of Search ..... 166/313, 119, 166/120, 123, 387, 191, 305.1

(56) References Cited

U.S. PATENT DOCUMENTS

| | | | | | |
|---|---|---|---|---|---|
| 2,368,428 | A | * | 1/1945 | Saurneman | 166/114 |
| 3,154,145 | A | * | 10/1964 | Brown | 166/313 |
| 3,239,008 | A | * | 3/1966 | Leutwyler | 166/119 |
| 3,951,211 | A | * | 4/1976 | Ellis | 166/377 |
| 4,756,364 | A | | 7/1988 | Christensen et al. | 166/101 |
| 4,794,989 | A | * | 1/1989 | Mills | 166/387 |
| 5,555,945 | A | | 9/1996 | Schultz et al. | 175/50 |
| 5,865,252 | A | | 2/1999 | Van Petegem et al. | 166/297 |
| 5,921,318 | A | | 7/1999 | Ross | 166/250.17 |
| 6,116,343 | A | | 9/2000 | Van Petegem et al. | 166/297 |
| 6,186,236 | B1 | | 2/2001 | Cox | 166/308 |
| 6,213,203 | B1 | * | 4/2001 | Edwards et al. | 166/55.1 |
| 6,220,349 | B1 | | 4/2001 | Vargus et al. | 166/138 |
| 6,257,338 | B1 | | 7/2001 | Kilgore | 166/387 |
| 6,394,184 | B2 | * | 5/2002 | Tolman et al. | 166/281 |
| 6,460,619 | B1 | * | 10/2002 | Braithwaite et al. | 166/259 |
| 2001/0018977 | A1 | | 9/2001 | Kilgore | 166/387 |

* cited by examiner

*Primary Examiner*—Kenn Thompson
(74) *Attorney, Agent, or Firm*—John W. Wustenberg; Warren B. Kice; James R. Bell

(57) ABSTRACT

A device and a method are provided for the hydraulic fracturing of multiple zones in a well bore. A stinger carries a plurality of packers into a well bore. Each packer is separably connected to each adjacent packer. As each packer is sequentially secured in the well bore, the stinger is withdrawn from the secured packer and the process is repeated as the remaining packers are sequentially secured and separated.

27 Claims, 6 Drawing Sheets

MULTIPLE ZONES FRAC TOOL

BACKGROUND

The disclosures herein relate generally to a device and a method for the hydraulic fracturing, also referred to as fracing, of multiple zones in a well bore.

During the production of oil from an oil well, one of the well bore operations involves fracing multiple zones of the well bore. The term "frac" means introducing a fluid into a sub-surface area of earth which is likely to yield a hydrocarbon product. The frac fluid facilitates collection of the product by creating a conduit in the zones in which the product is trapped. The product can then flow through the conduit into the well bore where the product can be collected. The fracing operations are often conducted after the well has been placed into production, therefore it is important that the fracing operation be conducted as quickly and efficiently as possible.

Some of the known methods to accomplish this involve retrievable methods where all elements or tools used in the fracing process are removed from the well bore. One method includes a bridge plug and a packer used with either jointed tubing or coiled tubing. A frac port is located between the bridge plug and the packer. Another method involves using at least two cups opposing each other with a frac port located between the cups. Still another method uses a straddle packer which straddles a zone. A cup is positioned above the zone. The frac port is located between the straddle packer and the cup.

Disadvantages of the retrievable methods are that the tools are complex and could become stuck in the well. A stuck tool would require fishing the tool out, drilling through the tool, or leaving the tool in the well. Drilling through the tool is difficult because the tool is formed of heat treated steel.

A more recent method involves the use of drillable tools, i.e., tools that are made of softer material and can be drilled out of the well. However, use of this method involves a first trip down the well to set a bridge plug below the frac zone and a second trip down the well to do the frac job. However, this process must be repeated for each zone. Therefore, if there are ten zones to be treated, twenty trips down the well are required. This is disadvantageous because it is time consuming and each trip causes wear on the coiled tubing. Therefore, cost and complexity of the operation are major disadvantages.

DETAILED DESCRIPTION

A service tool is provided for individually isolating and pumping fluid into multiple zones in a well or subterranean formation. A single trip downhole (into the well bore) is required to treat one or more zones. A second trip may be required to drill out drillable packers left behind in the casing. An advantage of this tool is that it can be used with either jointed tubing or coiled tubing.

Figure 1:
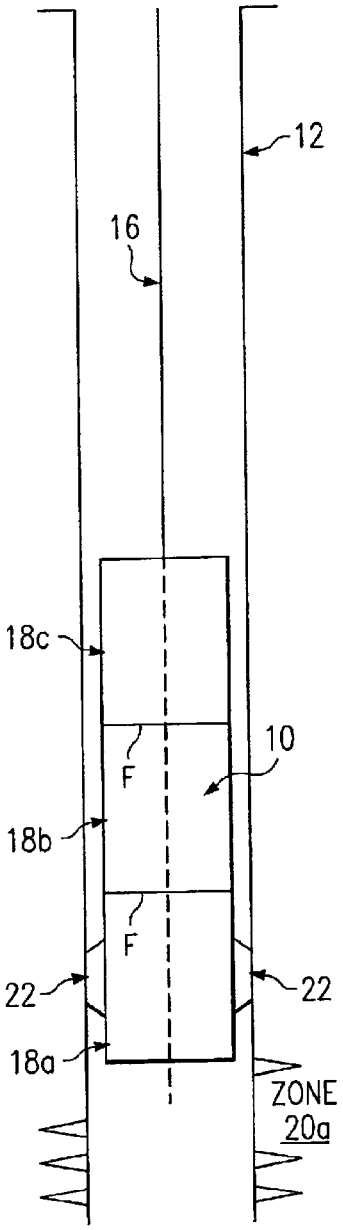
FIGS. 1–3 are diagrammatic views illustrating an embodiment of packers sequentially positioned in a well for treating zones in the well.
Figure 2:
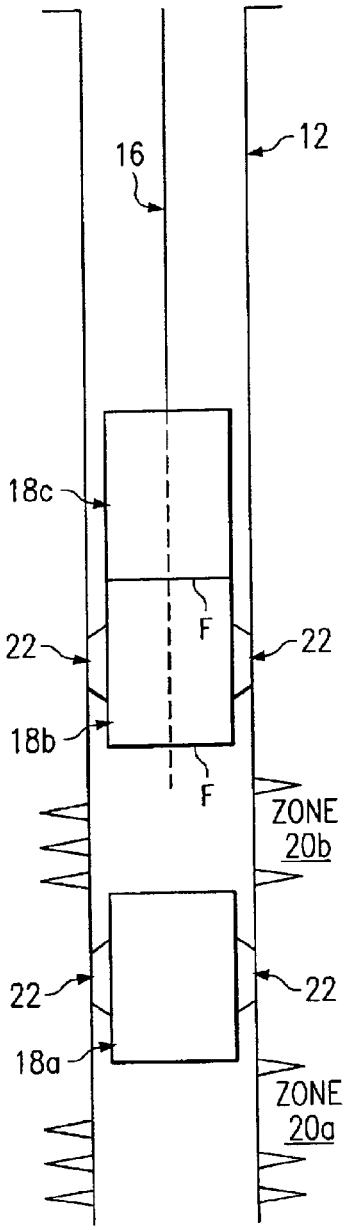
Figure 3:
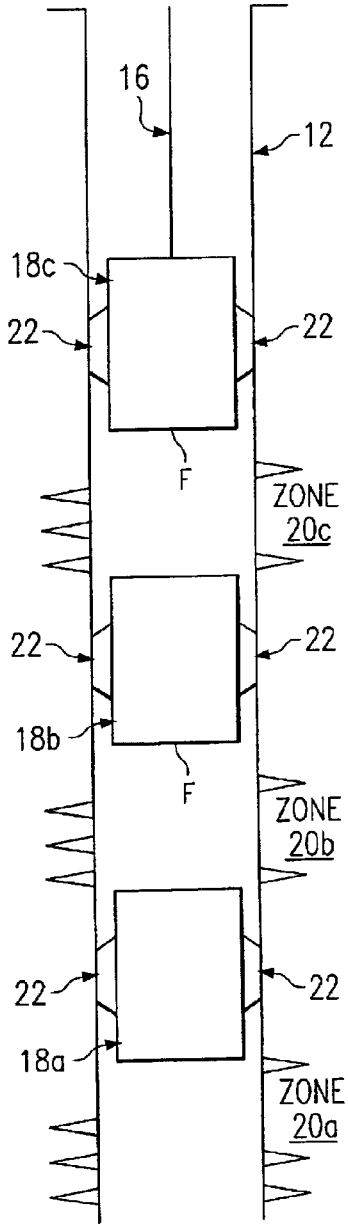

The tool includes a packer assembly 10 located in a well bore 12, FIG. 1. The well bore 12 can be either a cased completion as shown in FIG. 1 or an openhole completion. The packer assembly 10 includes a stinger 16 carrying a plurality of packers 18*a*, 18*b*, 18*c* in series. Each packer 18*a*, 18*b*, 18*c* is separably connected to each adjacent packer at a surface F. The stinger 16 is sequentially removable from the packers 18*a*, 18*b*, 18*c* so that after each packer 18*a*, 18*b*, 18*c* is sequentially secured by a securing means 22 to the well bore 12 and the zone below the packer is treated, the stinger 16 is withdrawn from the most distal secured packer, which remains in the well bore 12. For example, packer 18*a* is secured in well bore 12 by securing means 22 and zone 20*a* below packer 18*a* is treated by pumping fluid into the zone 20*a*. The stinger 16 is withdrawn from secured packer 18*a* which remains in well bore 12, thus continuing to isolate zone 20*a*, and the next packer 18*b* is sequentially secured to the well bore 12, FIGS. 2 and 3, and the zone 20*b* between packers 18*a* and 18*b* is treated. The stinger 16 is further withdrawn from secured packer 18*b* which remains in well bore 12, and so on, until each packer 18*a*, 18*b*, 18*c* is positioned adjacent a respective treated zone 20*a*, 20*b*, 20*c* and the stinger 16 is eventually completely withdrawn from the well bore 12. If the hole is not suitable, then in some instances, the first zone to be treated may be between packers 18*a* and 18*b*.

Figure 4:
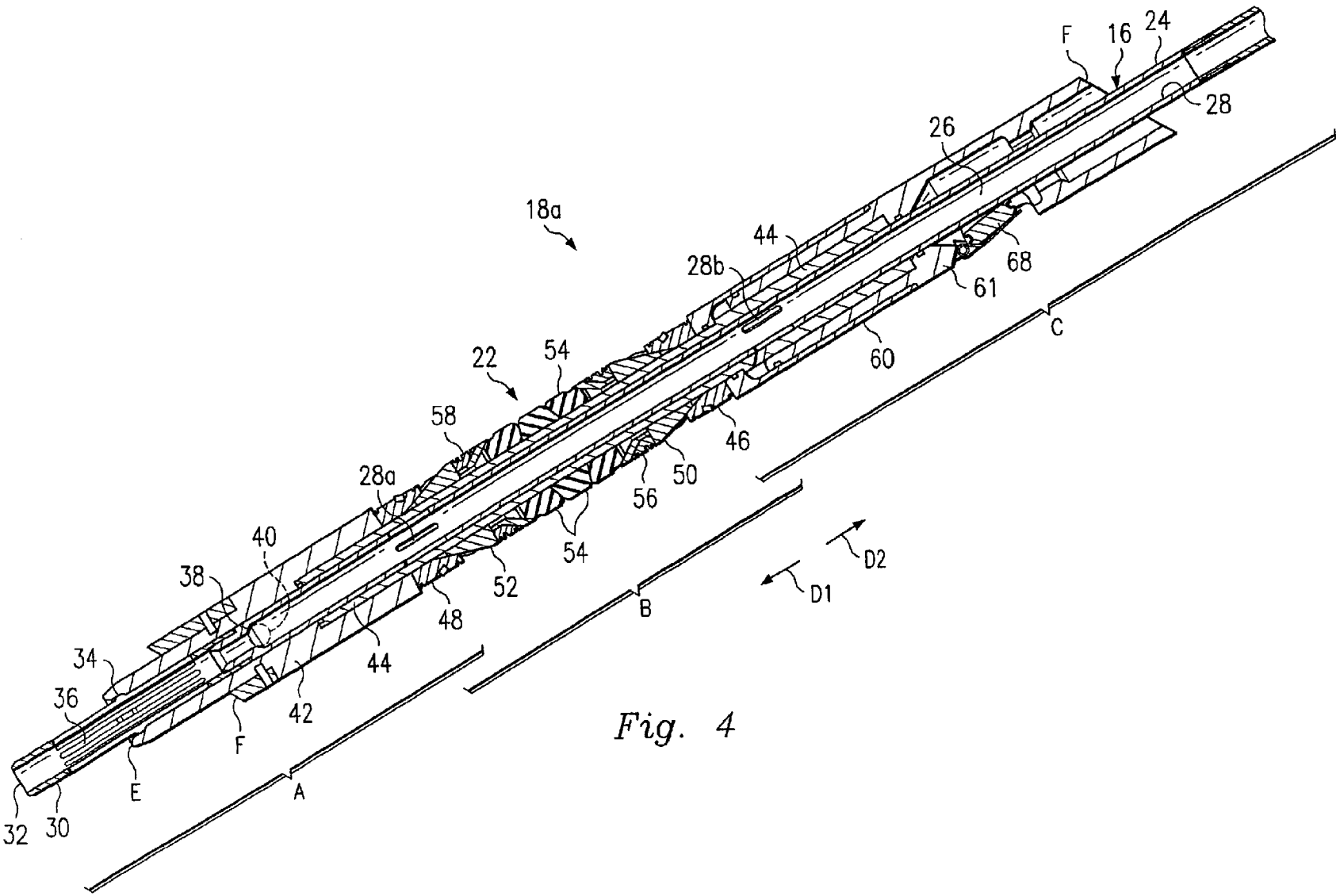
FIG. 4 is a cross-sectional side view illustrating a packer and stinger.

The stinger 16 is elongated and includes an outer diameter 24 slidably mounted in a passage formed in respective packer 18*a*, FIG. 4. An inner fluid passage 26 extends through stinger 16. A generally cylindrical wall of stinger 16 defines a ported mandrel 28 having a plurality of ports 28*a* and 28*b*. A collet mandrel 30 is formed on stinger 16 adjacent a distal open end 32 and includes a collet 34 and a plurality of elongated slots 36 adjacent the collet 34. The elongated slots 36 provide for radial compressibility of the collet mandrel 30. A ball seat 38 is also provided adjacent distal open end 32, for use in connection with a ball 40, discussed below.

Each packer 18*a*, 18*b*, 18*c* is identical and therefore, only one packer 18*a* is described in detail. In order to better illustrate the details of packer 18*a*, FIGS. 5–7 each include a portion of packer 18*a* as illustrated in its entirety in FIG. 4.

Figure 5:
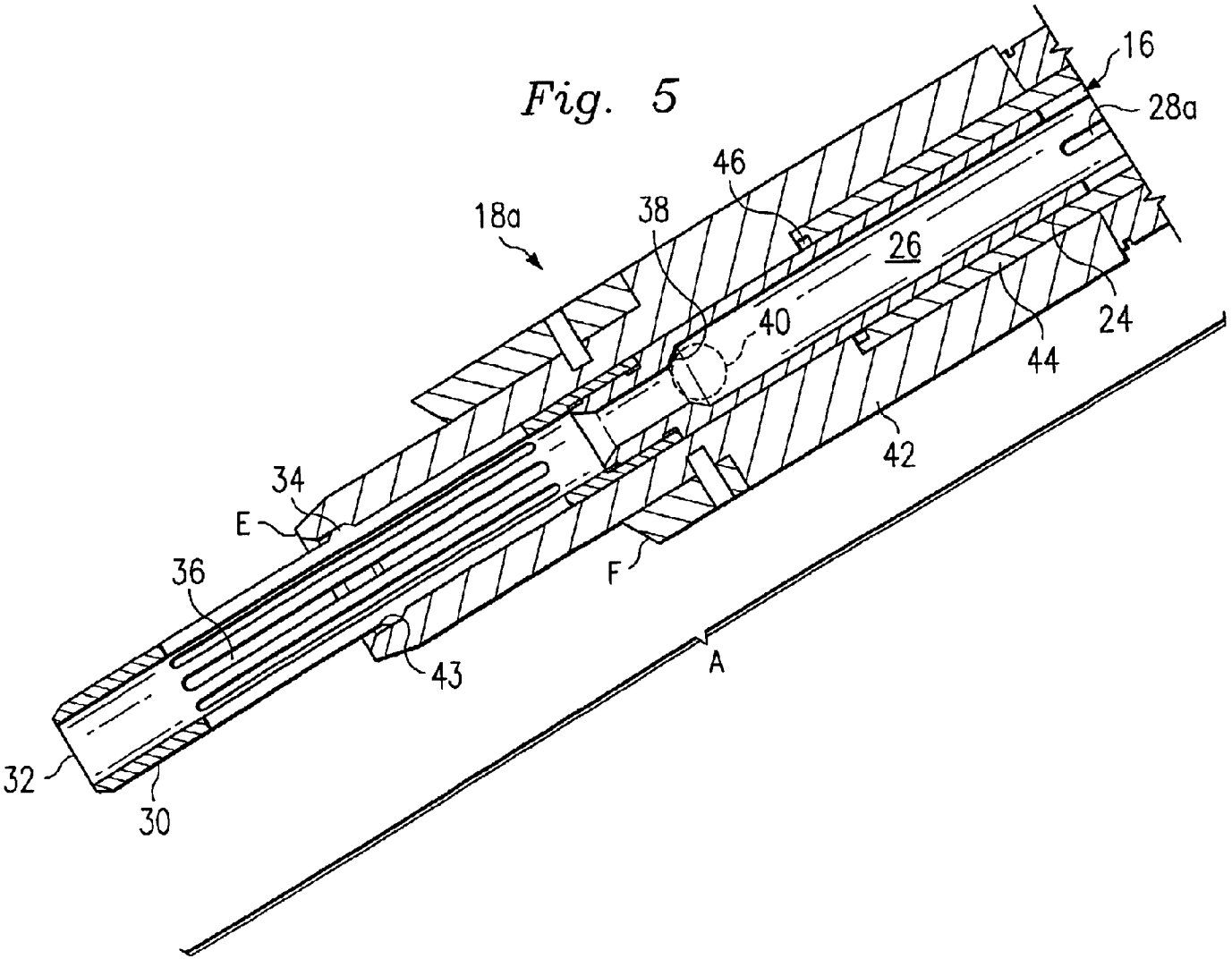
FIGS. 5–8 are cross-sectional side views partially illustrating portions of the packer and stinger of FIG. 4.

A first or distal portion A, FIGS. 4 and 5, of packer 18*a* is adjacent distal open end 32 of stinger 16. Distal portion A includes a mule shoe 42 fixedly connected to a packer mandrel 44. An o-ring seal 46 is seated in packer mandrel 44 and sealingly engages outer diameter 24 of stinger 16. A shoulder 43 is provided on mule shoe 42 for engaging collet 34.

Figure 6:
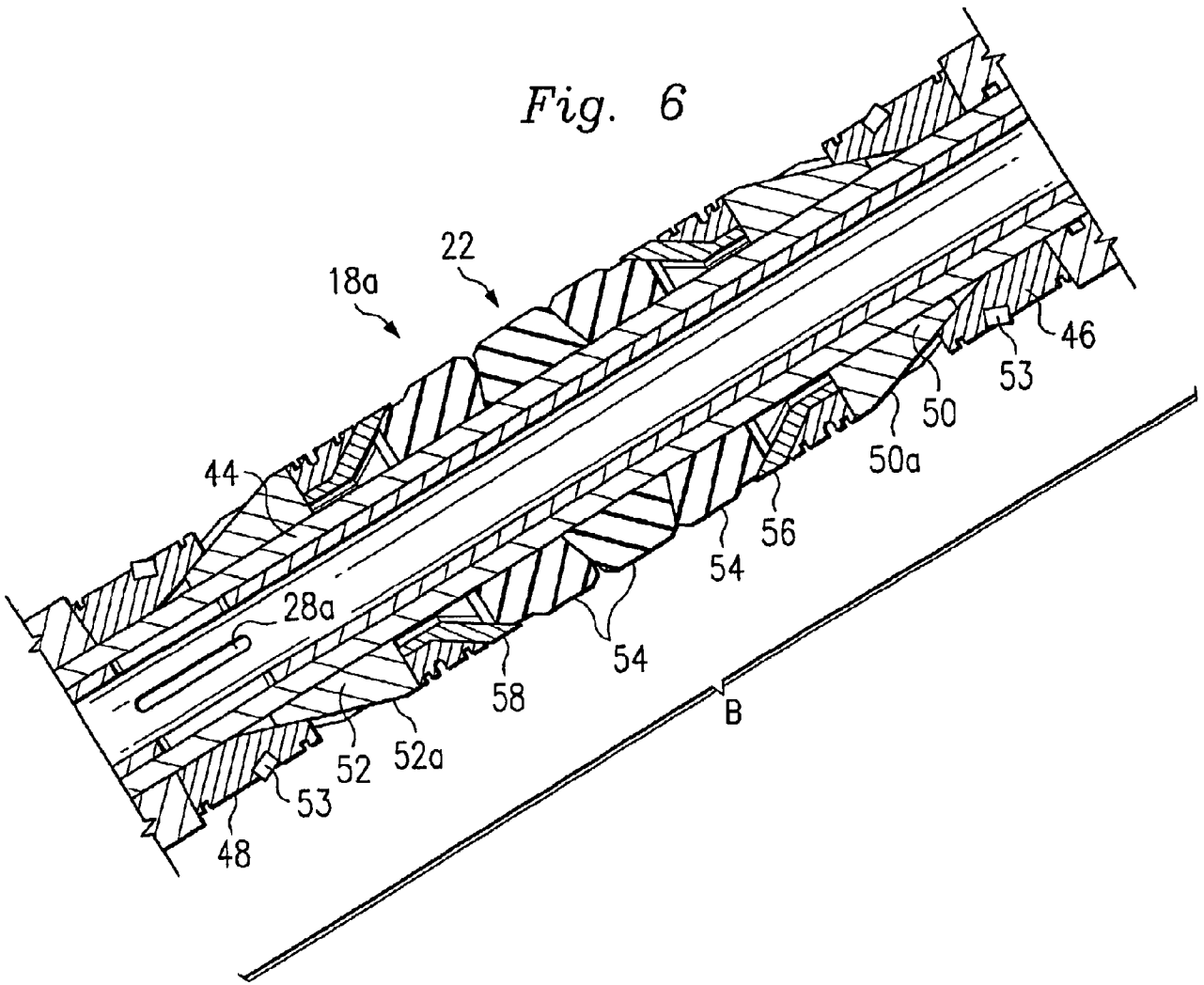

A second portion B, FIGS. 4 and 6 of packer 18*a* includes the securing means 22 mounted on the packer mandrel 44 and comprising an upper slip 46 and a lower slip 48. The upper slip 46 is provided to ride on a surface 50*a* of an upper wedge 50. Similarly, the lower slip 48 is provided to ride on a surface 52*a* of a lower wedge 52. Each slip 46 and 48 includes a plurality of teeth 53 for gripping engagement with well bore 12. A plurality of resilient packer elements 54 are mounted between the upper wedge 50 and the lower wedge 52. Also, an upper extrusion limiter 56 is between the upper wedge 50 and the packer elements 54, and a lower extrusion limiter 58 is between the lower wedge 52 and the packer elements 54. The elements referred to by the term "lower" are meant to be adjacent to the distal portion A.

Figure 7:
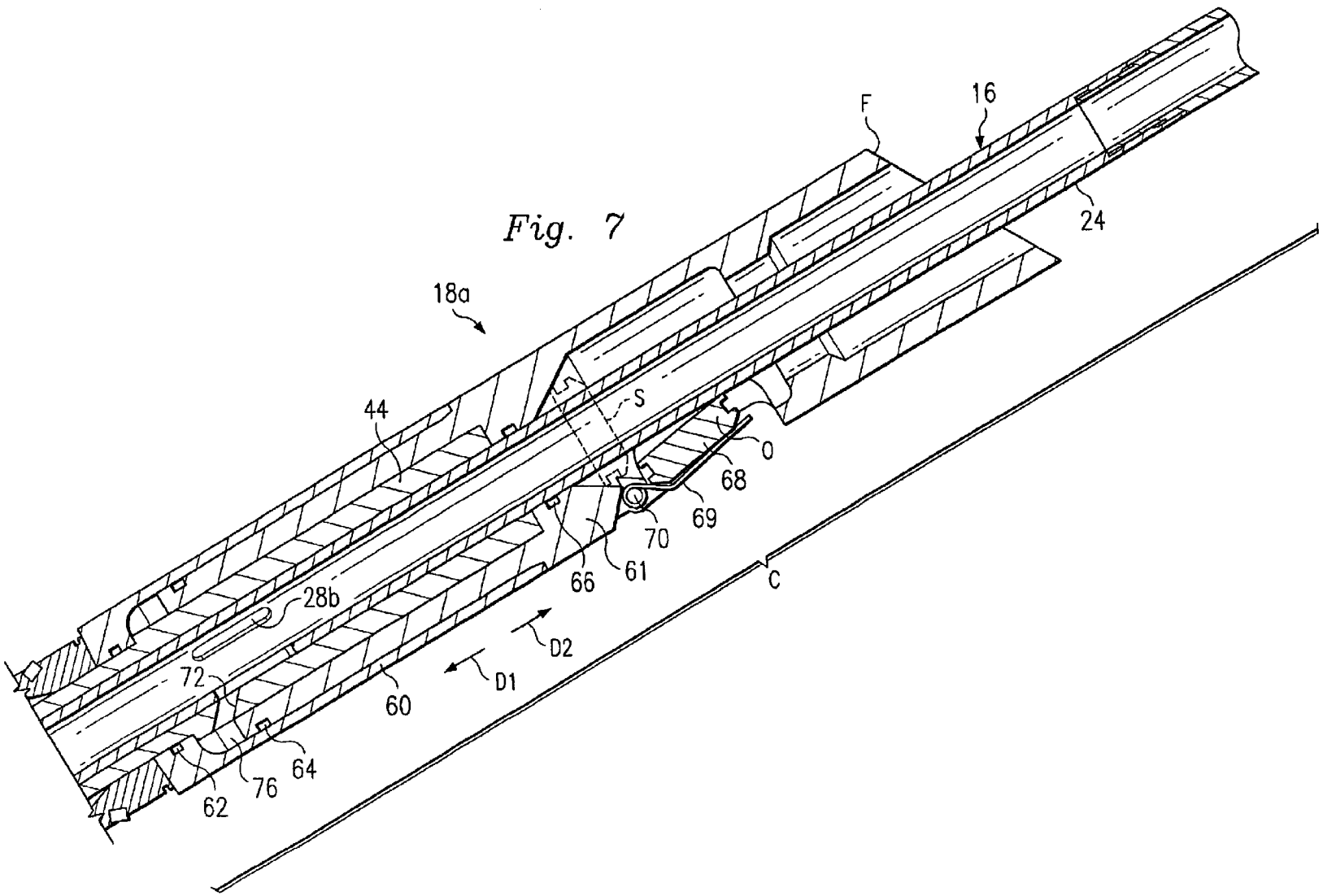
Figure 8:
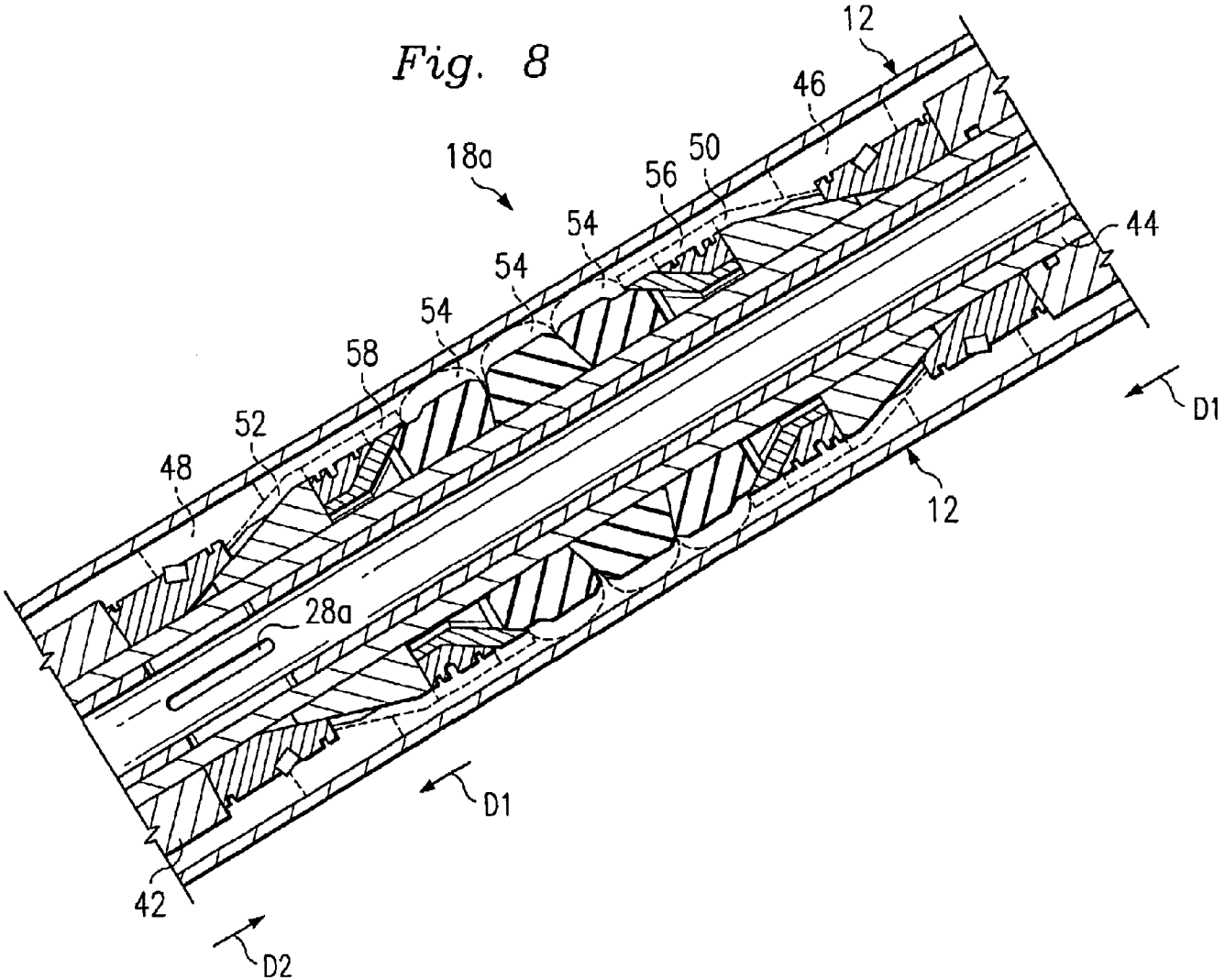

A third portion C, FIGS. 4 and 7 of packer 18*a* includes the packer mandrel 44 having a setting sleeve 60 sealingly mounted on packer mandrel 44 by a pair of o-ring seals 62 and 64. Also, an o-ring seal 66 is seated in packer mandrel 44 and sealingly engages outer diameter 24 of stinger 16. A flapper valve 68 is mounted on a flapper valve body 61, and is maintained in an open position O by engagement with outer diameter 24 of stinger 16. However, flapper valve 68 is biased by a spring 69 to pivot at a pivot point 70 to a closed position S, shown in phantom outline, upon removal of stinger 16 from packer element 18*a*.

A port 72 is formed in packer mandrel 44 adjacent the ports 28*b* of stinger 16. A chamber 76 is in fluid communication with port 72. Fluid pressure in chamber 76 moves the setting sleeve 60 to set the packer 18*a*.

In operation, ball 40, FIGS. 4–8, sealingly engages ball seat 38 to seal distal open end 32 of inner fluid passage 26. Pressurized fluid exits ports 28*a* and 28*b* and enters port 72 and chamber 76. Pressure acting on the differential area of setting sleeve 60 defined between o-ring seals 62 and 64 in a direction D1, activates upper slip 46 to ride on surface 50*a* and extend radially into engagement with well bore 12. Pressure also acts on the differential area between the o-ring seals 62 and 64 to move packer mandrel 44 relative to setting sleeve 60 in a direction D2, opposite D1. Movement of packer mandrel 44 also moves mule shoe 42 in direction D2 and thus activates lower slip 48 to ride on surface 52*a*, and extend radially into engagement with well bore 12. Movement of slips 46 and 48 urges wedges 50 and 52, respectively, to move toward each other which also moves upper extrusion limiter 56 and lower extrusion limiter 58 toward each other, thus compressing packer elements 54 and radially extending packer elements 54 and extrusion limiters 56 and 58. Packer elements 54 are thus radially extended into sealing engagement with well bore 12.

After a packer is set, stinger 16 is moved so that ports 28*a* and 28*b* are below a bottom end E of mule shoe 42. The fluid used for hydraulic fracturing is released under high pressure through the ports 28*a* and 28*b*. After fracturing is completed, removal of stinger 16 from the secured packer as stated above, permits flapper valve 68 to pivot and seal and the remaining packers are separated from the secured packer. The process is then repeated as the remaining packers are sequentially secured and separated. The flapper valve 68 provides the advantage that the operator can let the well produce immediately after fracing, and drill out the drillable packers at a convenient time.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A packer assembly for treating multiple zones in a well bore comprising:

a stinger movable in the well bore, the stinger having a fluid passage including a ball seat for sealing an end thereof;

a plurality of separably connected packers serially mounted on the stinger including at least a first distal packer and a second packer immediately adjacent the first packer;

the stinger operable to:

carry fluid to seal the first packer in a first position in the well bore;

introduce fluid adjacent the first packer to treat a first zone;

move the second packer relative to the first packer to a second position defining a space adjacent a second zone between the first and second packers;

carry fluid to seal the second packer in the second position; and introduce fluid into the space to treat the second zone.

2. The packer assembly as defined in claim 1 wherein the stinger includes a collet adjacent an end thereof engaged with a shoulder on an adjacent end of one of the packers.

3. The packer assembly as defined in claim 2 wherein the end of the stinger includes a plurality of elongated slots adjacent the collet for providing a radially compressible section of the stinger.

4. The packer assembly as defined in claim 1 wherein the stinger includes a plurality of ports in the fluid passage.

5. The packer assembly as defined in claim 1 wherein each packer includes a passage formed therein for receiving the stinger.

6. The packer assembly as defined in claim 5 wherein each packer includes a flapper valve adjacent an end thereof for closing the passage in response to removal of the stinger.

7. The packer assembly as defined in claim 1 wherein each packer includes radially extending packer elements for sealing the well bore.

8. The packer assembly as defined in claim 1 wherein each packer includes a mule shoe fixedly connected to a packer mandrel.

9. The packer assembly as defined in claim 8 wherein each packer includes a setting sleeve sealingly and movably mounted on the packer mandrel.

10. The packer assembly as defined in claim 9 wherein each packer includes a flapper valve mounted on the packer mandrel.

11. The packer assembly as defined in claim 10 wherein the flapper valve is pivotable between an open position and a closed position.

12. The packer assembly as defined in claim 10 wherein the flapper valve is biased by a spring to move from an open position to a closed position in response to removal of the stinger from the associated packer.

13. The packer assembly as defined in claim 9 further comprising;

a plurality of spaced apart slips mounted between the setting sleeve and the mule shoe; and at least one resilient packer element mounted between the slips.

14. A tool string for isolating and pumping fluid in multiple zones in a well bore comprising:

a stinger movable in the well bore, the stinger having a fluid passage including means for sealing an end thereof;

a plurality of separably connected packers serially stacked on the stinger including a first distal packer and a second packer immediately adjacent the first packer;

the stinger operable to:

carry fluid to seal the first packer in a first position in the well bore;

introduce fluid adjacent the first packer to treat a first zone;

move the second packer relative to the first packer to a second position defining a space adjacent a second zone between the first and second packers;

carry fluid to seal the second packer in the second position; and introduce fluid into the space to treat the second zone.

15. The tool string as defined in claim 14 wherein each packer further comprises:

slip means for grippingly engaging the well bore; and resilient packer element means for sealingly engaging the well bore.

16. The tool string as defined in claim 15 wherein the stinger is sequentially removable from each packer after the respective packer is secured in the well bore by the slip means and the resilient packer element means and the respective zone is treated.

17. The tool string as defined in claim 16 further comprising flapper valve means in each packer for isolating the respective treated zone when the stinger is removed from the respective packer.

18. A method of isolating and pumping fluids in multiple zones of a subterranean formation comprising:

providing a stinger movable in the formation;

providing a fluid passage in the stinger including a ball seat for sealing an end thereof;

mounting a plurality of separably connected packers on the stinger in series including at least a first distal packer and a second packer immediately adjacent the first packer;

the stinger carrying fluid to seal the first packer in a first position in the formation;

the stinger introducing fluid adjacent the first packer to treat a first zone;

the stinger moving the second packer relative to the first packer to a second position defining a space adjacent a second zone between the first and second packers;

the stinger carrying fluid to seal the second packer in the second position; and the stinger introducing fluid into the space to treat the second zone.

19. The method as defined in claim 18 further comprising:

providing each packer with a packer mandrel fixedly connected to a mule shoe; and slidably mounting a setting sleeve on the packer mandrel.

20. The method as defined in claim 19 further comprising mounting at least one slip between the setting sleeve and the mule shoe.

21. The method as defined in claim 20 further comprising mounting at least one resilient packer element between the setting sleeve and the mule shoe.

22. A method of isolating and pumping fluids in multiple zones of a well bore comprising:

providing a stinger movable in the well bore and having a fluid passage therein;

providing means for sealing an end of the fluid passage;

providing a plurality of separably connected packers wherein each packer has a passage therein for receiving the stinger;

mounting each packer on the stinger in series including at least a first distal packer and a second packer immediately adjacent the first packer;

the stinger carrying fluid to seal the first packer in a first position in the formation;

the stinger introducing fluid adjacent the first packer to treat a first zone;

the stinger moving the second packer relative to the first packer to a second position defining a space adjacent a second zone between the first and second packers;

the stinger carrying fluid to seal the second packer in the second position; and the stinger introducing fluid into the space to treat the second zone.

23. The method as defined in claim 22 further comprising:

removing the stinger from the first distal packer after pumping fluid into the first zone;

sealing the passage in the first distal packer upon removal of the stinger; and separating the first distal packer from any remaining packers mounted on the stinger;

wherein the first zone remains isolated due to the sealing engagement of the first distal packer with the well bore and the sealed passage in the first distal packer.

24. The method as defined in claim 23 wherein sealing the passage in the first distal packer upon removal of the stinger comprises pivoting a flapper valve from an open position to a dosed position in response to removal of the stinger.

25. The method as defined in claim 24 further comprising:

locating the stinger in the well bore so that the second packer mounted on the stinger is located above a second zone to be isolated;

isolating the second zone by sealingly engaging the well bore with the second packer; and pumping fluid through the fluid passage in the stinger into the second zone.

26. The method as defined in claim 25 further comprising:

removing the stinger from the second packer after pumping fluid into the second zone;

sealing the passage in the second packer upon removal of the stinger; and separating the second packer from any remaining packers mounted on the stinger;

wherein the second zone remains isolated due to the sealing engagement of the second packer with the well bore and the sealed passage in the second packer.

27. A method of isolating and pumping fluids in multiple zones of a well bore comprising:

providing a stinger movable in the well bore and having a fluid passage therein;

providing means for sealing an end of the fluid passage;

providing a plurality of separably connected packers wherein each packer has a passage therein for receiving the stinger;

mounting each packer on the stinger in series including at least a first distal packer and a second packer immediately adjacent the first packer;

the stinger carrying fluid to seal the first packer in a first position in the formation;

the stinger introducing fluid adjacent the first packer to treat a first zone;

the stinger moving the second packer relative to the first packer to a second position defining a space adjacent a second zone between the first and second packers;

the stinger carrying fluid to seal the second packer in the second position;

the stinger introducing fluid into the space to treat the second zone;

removing the stinger from the first distal packer after pumping fluid into the first zone;

sealing the passage in the first distal packer upon removal of the stinger, including pivoting a flapper valve from an open position to a closed position in response to removal of the stinger; and separating the first distal packer from any remaining packers mounted on the stinger;

wherein the first zone remains isolated due to the sealing engagement of the first distal packer with the well bore and the sealed passage in the first distal packer.

* * * * *